US011799241B2

(12) United States Patent
Rouillard et al.

(10) Patent No.: US 11,799,241 B2
(45) Date of Patent: Oct. 24, 2023

(54) ELECTRICAL CONNECTOR WITH LOCKING SPRING

(71) Applicant: Tyco Electronics France SAS, Pontoise (FR)

(72) Inventors: Xavier Rouillard, Pontoise (FR); Olivier Pamart, Pontoise (FR); Steven Lord, Pontoise (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 17/487,094

(22) Filed: Sep. 28, 2021

(65) Prior Publication Data

US 2022/0102915 A1 Mar. 31, 2022

(30) Foreign Application Priority Data

Sep. 30, 2020 (FR) ..... 2010013

(51) Int. Cl.
*H01R 13/64* (2006.01)
*H01R 13/627* (2006.01)

(52) U.S. Cl.
CPC ..... *H01R 13/64* (2013.01); *H01R 13/6273* (2013.01); *H01R 2201/26* (2013.01)

(58) Field of Classification Search
CPC ..... H01R 13/64; H01R 13/6271; H01R 13/6273; H01R 2201/26
USPC ..... 439/352, 489
See application file for complete search history.

(56) References Cited

U.S. PATENT DOCUMENTS

| | | | |
|---|---|---|---|
| 5,993,238 | A | 11/1999 | Kudo et al. |
| 8,968,021 | B1 | 3/2015 | Kennedy et al. |
| 9,017,090 | B2 | 4/2015 | Matsumoto et al. |
| 9,172,183 | B2 | 10/2015 | Siwek et al. |
| 2014/0154911 | A1 | 6/2014 | Matsumoto et al. |

(Continued)

FOREIGN PATENT DOCUMENTS

| | | |
|---|---|---|
| EP | 2840664 B1 | 6/2016 |
| EP | 3166185 B1 | 3/2019 |
| FR | 3008833 A1 | 1/2015 |

(Continued)

OTHER PUBLICATIONS

Extended European Search Report, Application No. 21199469.4-1201, dated Jan. 31, 2022, 5 pages.

(Continued)

*Primary Examiner* — Gary F Paumen
(74) *Attorney, Agent, or Firm* — Barley Snyder

(57) ABSTRACT

An electrical connector includes a housing formed in a single piece and including a recess, a compression spring disposed in the recess, and a position assurance element having a head disposed in the recess and inserted through a first end of the compression spring. The compression spring is unloaded in a plugged-in position of the electrical connector into a mating connector and opposes plugging of the electrical connector into the mating connector in a loaded state. The first end of the compression spring exerts a force only on the position assurance element, the position assurance element exerts a force on the one-piece housing, and a second end of the compression spring opposite the first end along a longitudinal axis of the compression spring exerts a force only on the recess of the housing.

16 Claims, 4 Drawing Sheets

(56) References Cited

U.S. PATENT DOCUMENTS

2015/0056841 A1* 2/2015 Siwek ..... H01R 13/6271
439/352

FOREIGN PATENT DOCUMENTS

JP 200563752 A 3/2005
JP 2014110182 A 6/2014

OTHER PUBLICATIONS

French Search Report, FR App No. 2010013, dated Jun. 11, 2021, 8 pages.
Indian Search Report, Application No. 202144043837, dated May 19, 2022, 5 pages.
Japanese Office Action corresponding to Application No. 2021-156227, dated Aug. 30, 2022 with English translation thereof, 10 pages.

* cited by examiner

[Fig. 1]
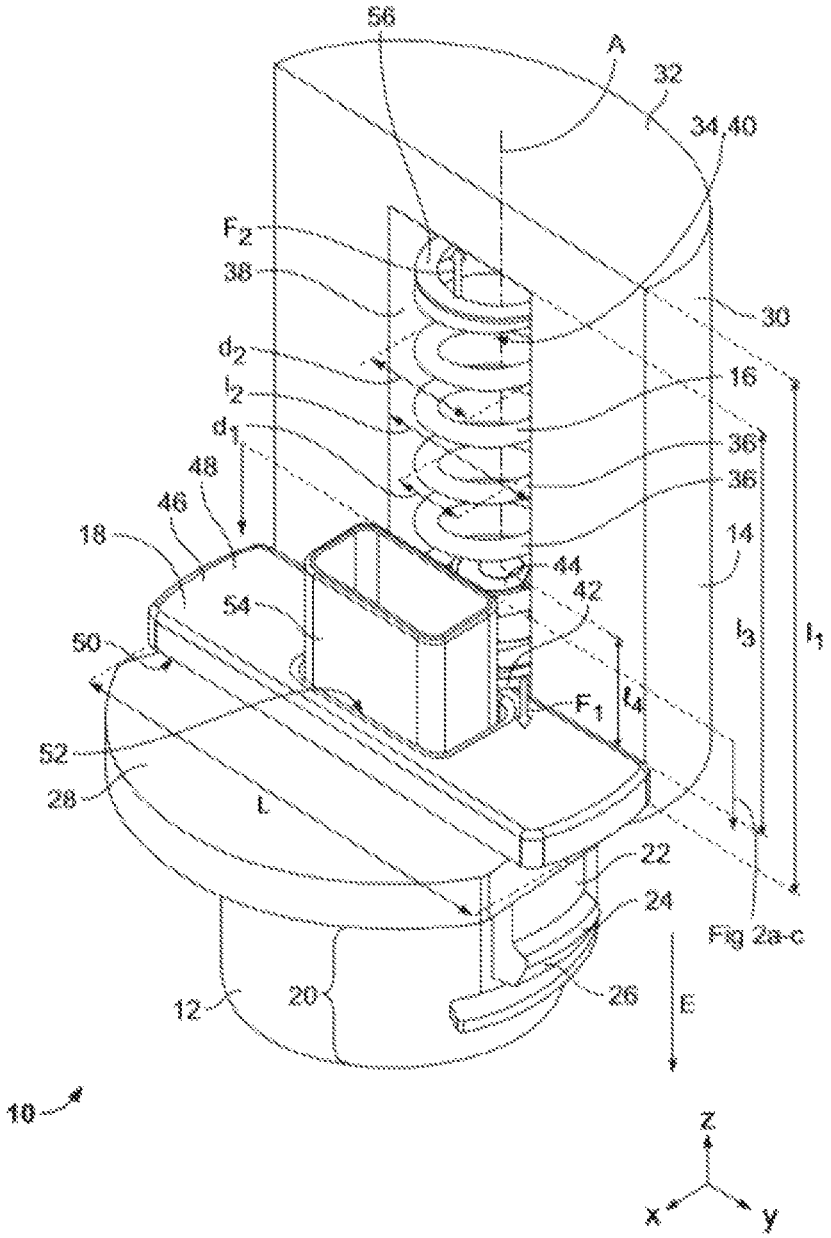

[Fig. 2a]
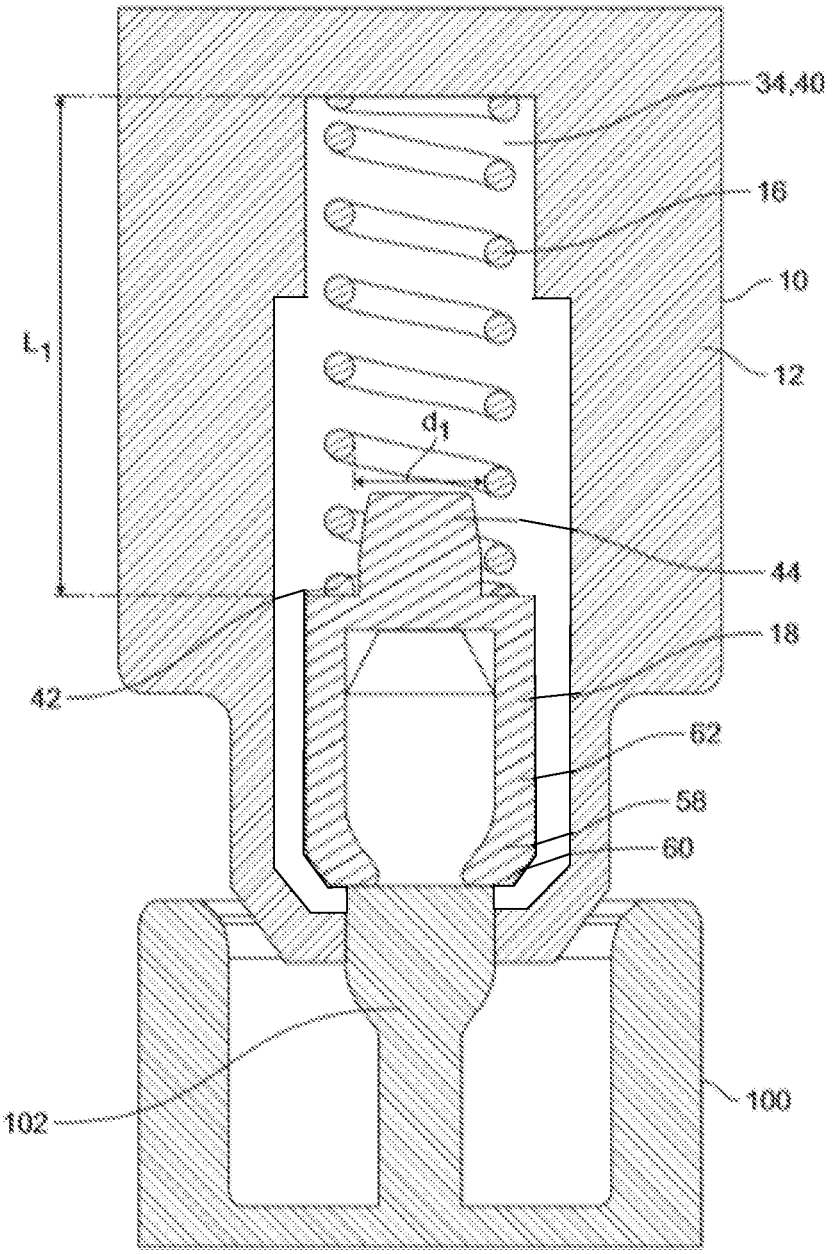

[Fig. 2D]
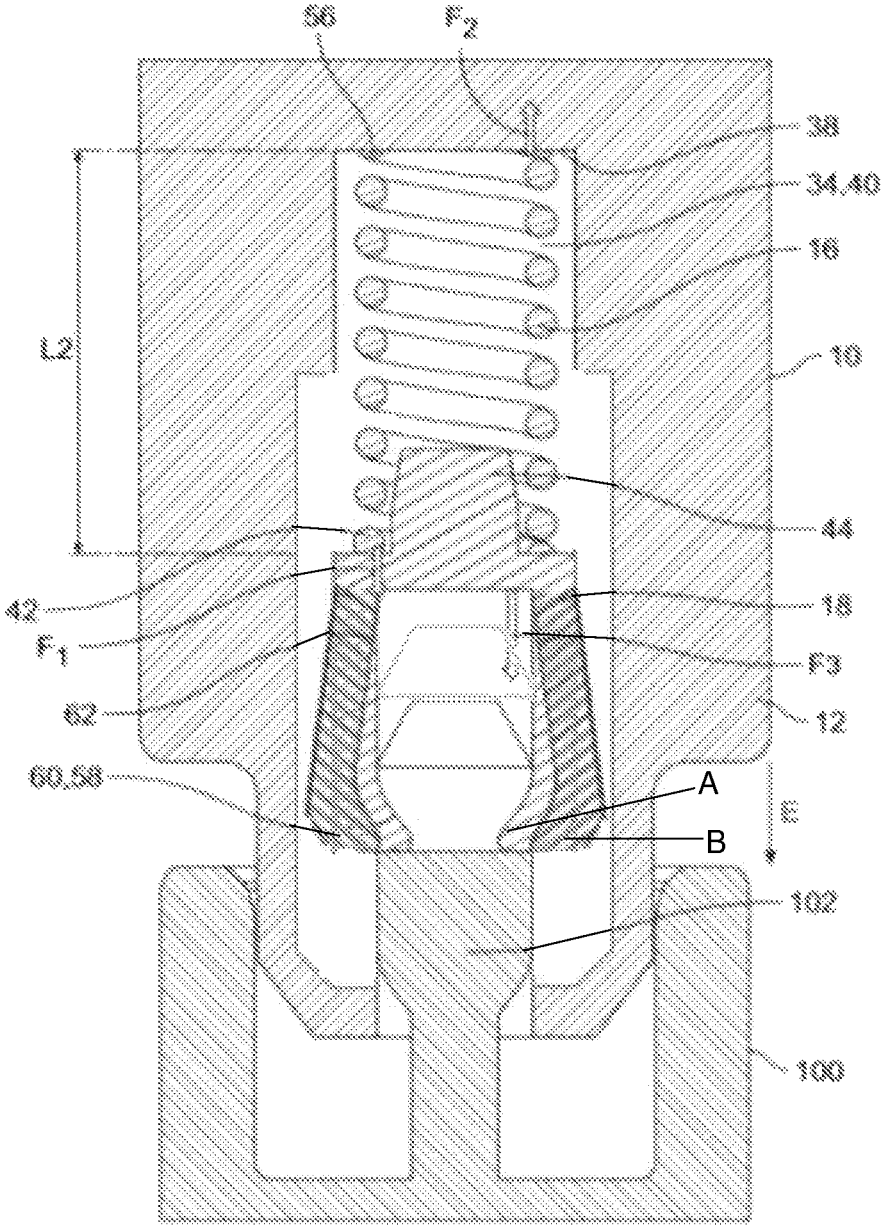

[Fig. 2c]
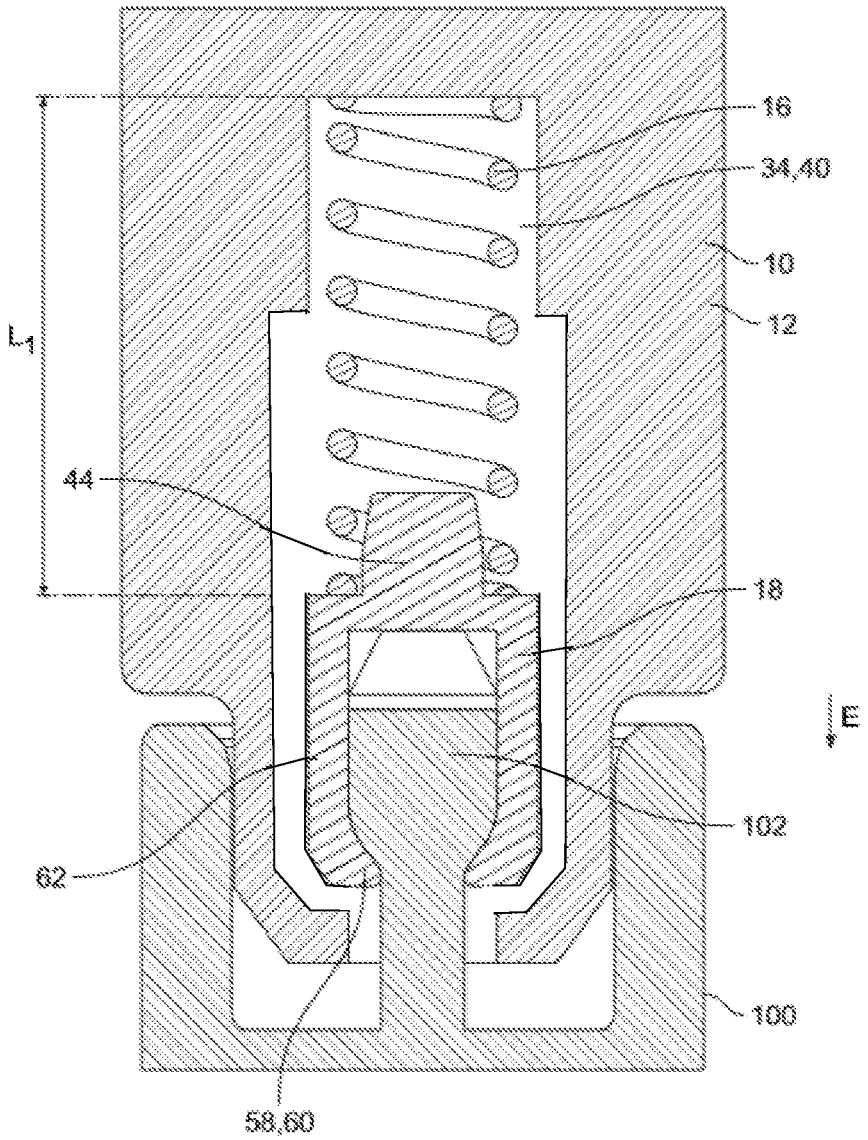

ELECTRICAL CONNECTOR WITH LOCKING SPRING

CROSS-REFERENCE TO RELATED APPLICATIONS

This application claims the benefit of the filing date under 35 U.S.C. § 119(a)-(d) of French Patent Application No. 2010013, filed on Sep. 30, 2020.

FIELD OF THE INVENTION

The present invention relates to an electrical connector and, more particularly, to an electrical connector with a locking spring.

BACKGROUND

Electrical connectors which are in routine use for safety belts or for the airbags of automotive vehicles are known to comprise pyrotechnic devices which can initiate clamping of a belt or inflation of an airbag as a function of shock or vibrational information received by the sensors of the vehicle. Such electrical connectors can incorporate a secondary locking system or connector position assurance device (CPA), which can be used to monitor and ensure correct coupling with the mating electrical connector maintained in an environment which may be regularly subjected to shocks or to vibrations, as is typically the case with an automotive vehicle. The secondary locking can use a spring which can be used to change the secondary locking element from one predetermined position to another predetermined position; the secondary locking can use a U-shaped rod and spring, a helical torsion spring, or a helical compression spring.

These springs are usually disposed between two or more portions constituting the electrical connector, such as between a portion forming a cover and the housing of the connector. The cover is generally snap fitted to the connector. However, there is still a risk that these portions of the connector could come apart under the force exerted by the spring when it is biased, i.e. preloaded. The restoring force of the locking spring may in fact be such that it causes the two or more portions constituting the connector to unclip.

SUMMARY

An electrical connector includes a housing formed in a single piece and including a recess, a compression spring disposed in the recess, and a position assurance element having a head disposed in the recess and inserted through a first end of the compression spring. The compression spring is unloaded in a plugged-in position of the electrical connector into a mating connector and opposes plugging of the electrical connector into the mating connector in a loaded state. The first end of the compression spring exerts a force only on the position assurance element, the position assurance element exerts a force on the one-piece housing, and a second end of the compression spring opposite the first end along a longitudinal axis of the compression spring exerts a force only on the recess of the housing.

BRIEF DESCRIPTION OF THE DRAWINGS

The invention will now be described by way of example with reference to the accompanying Figures, of which:

FIG. 1 is a perspective view of an electrical connector according to an embodiment;

FIG. 2*a* is a sectional side view of a first step for plugging the electrical connector into a mating connector;

FIG. 2*b* is a sectional side view of an intermediate step for plugging the electrical connector into the mating connector; and FIG. 2*c* is a sectional side view of a final step for plugging the electrical connector into the mating connector.

DETAILED DESCRIPTION OF THE EMBODIMENT(S)

The invention will now be explained in more detail below with the aid of embodiments and with reference in particular to the accompanying figures. The embodiments described herein may be combined in order to produce even more variations of embodiments of the present invention.

An electrical connector 10 according to an embodiment is shown in FIG. 1. In the embodiment illustrated in FIG. 1, the electrical connector 10 is a spring locking connector for an automotive vehicle airbag squib system which can be coupled to a mating connector. In this embodiment, the electrical connector 10 is a squib connector for a safety restraint system for an automotive vehicle. The electrical connector 10 is configured to be ejected automatically when it is improperly inserted or is not fully coupled to a mating connector. In other embodiments, the electrical connector 10 could be another type of spring locking connector.

The electrical connector 10, as shown in FIG. 1, comprises a housing 12 with a principal portion 14 comprising a locking spring 16 and a position assurance element of the connector 18, which will be referred to below as "CPA 18". The electrical connector 10 further comprises a plug-in portion 20 which is cylindrical in shape and which is configured to be connected to a mating connector along a plug-in direction E, indicated by the arrow denoted E in FIG. 1.

The housing 12 of the electrical connector 10 is one-piece in the shown embodiment. Thus, the portions 14 and 20 of the housing 12 constitute a single part, formed by injection molding, for example. This leads to simple and inexpensive production of the housing 12. Steps for assembling the one-piece housing 12 are therefore not necessary, which saves time when assembling the connector 10. The integrally formed portions 14 and 20 of the housing 12 are described in more detail below.

The plug-in portion 20 comprises two locking arms (only one locking arm 22 is visible in the view of FIG. 1). Each locking arm 22 comprises a free end 24 provided with a locking lug 26 configured for being housed in a locking zone of a mating connector in a plugged-in position). The plugged-in position corresponds to a position in which the electrical connector 10 is correctly plugged into, i.e. coupled with, a mating connector.

The principal portion 14 comprises a flat base 28 from which a portion 30 extends transversely over a length 11 in a direction opposite to the plug-in direction E. In the embodiment illustrated in FIG. 1, the portion 30 has a substantially semi-circular cross section 32. In other embodiments, the cross section of the portion 30 may have a different shape. However, in a manner which is common to all of the embodiments, the portion 30 comprises a recess 34 sized for receiving the locking spring 16.

In the embodiment illustrated in FIG. 1, the locking spring 16 is a helical compression spring 16 with a longitudinal axis A. In a variant not shown, the locking spring 16 may be a compression wave spring. Herein below, the terms "spring", "locking spring", "compression spring" and "helical spring" make reference to the same element: the spring 16 illustrated in FIG. 1.

The locking spring 16 is configured to be unloaded in the plugged-in position. Furthermore, the spring 16 is configured to oppose plugging of the connector 10 into a mating connector in a loaded state of the spring 16. In the loaded state of the spring 16, its ends each exert a restoring force.

The longitudinal axis A of the compression spring 16 is parallel to the plug-in direction E. The restoring forces of the spring 16 are therefore exerted in a direction parallel to the plug-in direction E. For this reason, the spring 16 is configured to oppose improper connection of the connector 10 with a mating electrical connector.

The locking spring 16 comprises a plurality of turns 36 with an internal diameter d1 and with an external diameter d2, in a manner such that d1<d2. The external diameter d2 of the locking spring 16 is substantially equal to that of the width 12 of the recess 34, so that when the spring 16 is housed in the recess 34, the turns 36 of the spring 16 are in contact with the wall 38 of the recess 34.

In the embodiment shown in FIG. 1, the recess 34 is a groove 40 with a semi-circular section. The width 12 of the semi-circular section of the groove 40 is substantially equal to the external diameter d2 of the locking spring 16. The length 13 of the groove 40 corresponds substantially to the length of the spring 16 along the longitudinal axis A in its unloaded state. The groove 40 therefore has a complementary shape adapted to receive the spring 16. The recess 34 thus has a shape adapted for accommodating a helical compression spring.

A first end 42 of the spring 16 is disposed around a head 44 of the CPA 18 which is disposed in the recess 30 of the one-piece housing 12, as shown in FIG. 1. The head 44 of the CPA 18 may have a cross section which is circular, triangular, square, rectangular or oval in shape. In each of these variations, in order to retain the spring 16 sufficiently on the head 44 of the CPA 18, the largest dimension of the cross section of the head 44 is substantially equal to the internal diameter d1 of the compression spring 16. Furthermore, in order to further guarantee retention, at least two turns 36 of the spring 16 are in contact with the head 44 of the CPA 18 when the spring 16 is in its unloaded state, i.e. when it does not apply any force/restoring force. The head 44 extends over a predetermined height such that at least two turns 36 of the spring 16 are in contact with the head 44 when the connector 10 is in the delivery position.

The structure and the geometry of the head 44 are therefore adapted for being capable of sufficiently retaining the spring 16 on the head 44. It is therefore not necessary to use additional parts, such as a cover, in order to retain the compression spring 16 on the one-piece housing 12. In addition to preventing the spring 16 from exerting a force on such parts, which could generate a risk of uncoupling of the connector 10, this offers the possibility of advantageously reducing the number of elements constituting the electrical connector 10.

In a delivery position of the connector 10, i.e. when the connector 10 is not plugged into a mating connector, the spring 16 is in its unloaded state.

The head 44 of the CPA 18 extends transversely over a length 14 from a first surface 46 of a flat base 48 of the CPA 18. In the embodiment illustrated in FIG. 1, the flat base 48 has a substantially rectangular cross section. The head 44 and the flat base 48 of the CPA 18 form a one-piece part. The head 44 is disposed adjacent to one of the long sides L of the flat base 48 of the CPA 18. The head 44 therefore protrudes in a plane (XY) from the flat base 48, as can be seen in FIG. 1. Only the head 44 of the CPA 18 is housed in the recess 34 of the housing 12. The rest of the CPA 18, i.e. the flat base 48, is configured to rest on the flat base 28 of the principal portion 14 of the housing 12. Thus, the second surface 50 of the flat base 48, which is opposite to the first surface 46, is configured so as to be in contact with the flat base 28 of the principal portion 14 of the housing 12.

As shown in FIG. 1, the flat base 48 of the CPA 18 comprises an opening 52 sized so that a hollow portion 54 of the housing 12 into which the terminals of the electrical pins of the connector are to be introduced can pass through it.

The CPA 18 furthermore comprises two locking arms (not visible in FIG. 1, see reference numerals 62 in FIGS. 2*a*-2*c*) which extend transversely from the second surface 50 of the flat base 48. The two locking arms 62 are configured to lock with a corresponding locking device of the mating electrical connector in the plugged-in position.

In other embodiments, the structure and the geometry of the flat base 48 of the CPA 18 may vary from those illustrated in FIG. 1. However, what is common to all of the embodiments is that the CPA 18 comprises a head 44 which is configured to be housed in the recess 34 and be inserted through the first end 42 of the locking spring 16.

Because the housing 12 is one-piece, the principal portion 14, the plug-in portion 20, the portion 30, the hollow portion 54 and the recess 34 form one and the same part which is produced as a single piece.

The one-piece structure of the housing 12 and the disposition of the compression spring 16 in the recess 30 (i.e. the groove 40) mean that the restoring forces of the spring 16, indicated by the arrow F1 at the first end 42 of the spring 16 and by the arrow F2 at the second end 56 in FIG. 1, are exerted only on the housing 12 and the CPA 18, which in turn, by reaction, exerts a force in the plug-in direction E only on the flat surface 28 of the housing 12. In other words, all of the forces exerted by the spring 16, which are applied in a direction parallel to the plug-in direction E and both in the direction F1 as well as in the direction F2, are passed back onto the one-piece housing 12 only. It should be noted that the forces F1 and F2 are opposed. The forces F1 and F2 may be equal.

Any other portion which could constitute the connector 10, such as a cover, for example, is not subjected to the forces exerted by the spring 16. In other words, although an element or a cover could be snap fitted to the housing 12, for example to the flat base 28 or to the portion 30, this element or this cover would not have the function of retaining the spring 16 which is already held in the groove 40 with its first end disposed around the head 44 of the CPA 18 and its second end 56 coming to bear directly against the wall 38 of the recess 34. The function of retaining the spring 16 is thus ensured by the one-piece housing 12. As a consequence, all of the forces that the spring 16 might exert are applied to the one-piece housing 12 only. The compression spring 16 is disposed in a manner such that it does not exert any force on portions of the connector 10 for accommodating at least one pin of the connector 10 and/or forming a cover.

The connector 10 is thus configured such that the restoring force F1, F2 at each end 42, 56 of the spring 16 is applied to the housing 12 only. For this reason, the housing 12 being a one-piece, uncoupling of the connector 10 under the effect of the forces exerted by the spring 16 is prevented. A disengagement can therefore be avoided, all of the forces of the spring 16 being applied to one and the same part which is formed as a single piece, i.e. the one-piece housing 12.

FIGS. 2*a* to 2*c* diagrammatically illustrate sectional views of various steps of plugging an electrical connector 10 according to the present invention into a mating connector 100.

In the step illustrated in FIG. 2*a*, the electrical connector 10 is in the delivery position. In the delivery position, the spring 16 housed in the groove 40 (i.e. the recess 34) of the one-piece housing 12 is in an unloaded state. In other words, the spring 16 is not loaded: its length L1 is substantially equal to its initial length at rest, L1. The head 44 of the CPA 18 is housed in the internal diameter d1 of the spring 16, through the first end 42 of the spring 16. In the step illustrated in FIG. 2*a*, the lugs 58 at the ends 60 of each locking arm 62 of the CPA 18 abut against a protuberance 102 of the mating connector 100. The shape of the recess 34 is therefore adapted for accommodating a helical compression spring 16 in an unloaded state. This can prevent the compression spring from exerting anything more than small force in the delivery position.

In the step illustrated in FIG. 2*b*, the electrical connector 10 is displaced towards the mating connector 100 in the plug-in direction E. It is in an intermediate position between the delivery position and the plugged-in position. Because the lugs 58 at the ends 60 of each locking arm 62 of the CPA 18 are still abutting the protuberance 102 of the mating connector 100, the displacement of the electrical connector 10 causes a compression of the spring 16. For this reason, the spring 16 has a length L2 which is shorter than its length at rest, L1. As a reaction to this compression, the spring 16 exerts a restoring force F1, F2 at each of its ends 42, 56.

At the first end 42 of the spring 16, a restoring force F1 is applied to the CPA 18, which, as a reaction, in turn applies a force F3 onto the one-piece housing 12, as explained with reference to FIG. 1. The force of reaction F3 is in the same direction and in the same sense as the plug-in direction. As shown in FIG. 2*b*, at the second end 56 of the spring 16, a restoring force F2 is applied to the wall 38 of the groove 40 of the one-piece housing 12.

In the step illustrated in FIG. 2*c*, the electrical connector 10 is in the plugged-in position. In other words, the electrical connector 10 is correctly coupled to the mating connector 100. Under the effect of the relaxation of the spring 16 and of the exerted restoring forces F1, F2, the CPA 18 is pushed further in the plug-in direction E and its lugs 58 come into abutment against the protuberance 102 of the mating connector 100 until the locking arms 62 move apart from one another, shown in the movement from a first state A of the locking arms 62 to a second state B of the locking arms 62 in FIG. 2*b*. In other words, under the effect of the forces exerted on the CPA 18 where the lugs 58 are bearing on the protuberance 102, a deflection of each of the locking arms 62 to state B is generated. Upon opening, the locking arms 62 produce a gap which is sufficient for the protuberance 102 of the mating connector 100 to be able to pass through during displacement of the CPA 18 in the plug-in direction.

Thus, in the plugged-in position in FIG. 2*c*, the locking arms 62 of the CPA 18 have been deflected in a manner such that under the effect of the displacement of the electrical connector 10 in the plug-in direction E, the lugs 58 of the CPA 18 become housed below the protuberance 102 of the electrical connector 100, therefore locking the CPA 18 in a locking position of the CPA. The protuberance 102 will then be able to prevent lifting of the CPA 18 in a sense which opposes the plug-in direction E by producing an abutment for the lugs 58 of the locking arms 52.

The position assurance element 18 is configured both for a function of locking in the plugged-in position and for a function of retaining the compression spring 16 on the one-piece housing 12. The structure of the position assurance element 18 is adapted for allowing versatile use of said position assurance element 18. As a consequence, it is now possible to avoid the use of additional elements of the housing in order to carry out these two functions.

In the plugged-in position shown in FIG. 2*c*, the spring 16 regains its initial state, i.e. it is no longer biased or preloaded. Thus, its length L1 is substantially equal to its initial length at rest, L1.

In another embodiment, an electrical connector assembly according to the invention includes the connector 10, as described above, plugged into and locked onto the mating connector 100.

The embodiments described are simply possible configurations and it should be borne in mind that the individual characteristics of the various embodiments may be combined together or provided independently of each other.

What is claimed is:

1. An electrical connector, comprising:

a housing formed in a single piece and including a recess;

a compression spring disposed in the recess, the compression spring is unloaded in a plugged-in position of the electrical connector into a mating connector along a plug-in direction, the compression spring opposes plugging of the electrical connector into the mating connector in a loaded state of the compression spring; and a position assurance element having a head disposed in the recess and inserted through a first end of the compression spring, the position assurance element is displaceable in the plug-in direction when the electrical connector is plugged into the mating connector from a delivery position toward the plugged-in position, the first end of the compression spring exerts a force only on the position assurance element, the position assurance element exerts a force on the single piece housing, a second end of the compression spring opposite the first end along a longitudinal axis of the compression spring exerts a force only on the recess of the housing.

2. The electrical connector of claim 1, wherein the plug-in direction is parallel to the longitudinal axis of the compression spring.

3. The electrical connector of claim 1, further comprising a portion accommodating a pin of the electrical connector and/or forming a cover.

4. The electrical connector of claim 3, wherein the compression spring does not exert force on the portion.

5. The electrical connector of claim 1, wherein the recess is a groove with a semi-circular section.

6. The electrical connector of claim 5, wherein a length of the groove is substantially equal to a length of the compression spring along the longitudinal axis of the compression spring when the spring is in an unloaded state.

7. The electrical connector of claim 1, wherein the head extends over a predetermined height and at least two turns of the compression spring are in contact with the head when the electrical connector is in the delivery position.

8. The electrical connector of claim 1, wherein the head has a cross section which is circular, triangular, square, rectangular or oval in shape.

9. The electrical connector of claim 8, wherein the head has a largest dimension substantially equal to an internal diameter of the compression spring.

10. The electrical connector of claim 1, wherein the head extends transversely from a first surface of a base of the position assurance element and at least two locking arms extend transversely from a second surface of the base, the second surface is opposite to the first surface.

11. The electrical connector of claim 10, wherein the locking arms lock with a corresponding locking device of the mating connector in the plugged-in position.

12. The electrical connector of claim 11, wherein, when the electrical connector is plugged into the mating connector from the delivery position to the plugged-in position, the first end of the compression spring exerts the force on the first surface of the base.

13. The electrical connector of claim 12, wherein the second surface of the base exerts the force on the single piece housing.

14. The electrical connector of claim 1, wherein the electrical connector is a squib connector for a safety restraint system in an automotive vehicle.

15. An electrical connector assembly, comprising:

a mating connector; and an electrical connector plugged into and locked onto the mating connector along a plug-in direction in a plugged-in position, the electrical connector including a housing formed in a single piece and having a recess, a compression spring disposed in the recess, and a position assurance element having a head disposed in the recess and inserted through a first end of the compression spring, the compression spring is unloaded in the plugged-in position, the compression spring opposes plugging of the electrical connector into the mating connector in a loaded state of the compression spring, the position assurance element is displaceable in the plug-in direction when the electrical connector is plugged into the mating connector from a delivery position toward the plugged-in position, the first end of the compression spring exerts a force only on the position assurance element, the position assurance element exerts a force on the single piece housing, a second end of the compression spring opposite the first end along a longitudinal axis of the compression spring exerts a force only on the recess of the housing.

16. The electrical connector assembly of claim 15, wherein the position assurance element has a pair of locking arms locked with a corresponding locking device of the mating connector in the plugged-in position.

* * * * *